US009568892B2

(12) United States Patent
Fujisawa

(10) Patent No.: US 9,568,892 B2
(45) Date of Patent: Feb. 14, 2017

(54) ELECTRONIC TIMEPIECE

(71) Applicant: Seiko Epson Corporation, Tokyo (JP)

(72) Inventor: Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/863,634

(22) Filed: Sep. 24, 2015

(65) Prior Publication Data

US 2016/0103429 A1 Apr. 14, 2016

(30) Foreign Application Priority Data

Oct. 9, 2014 (JP) ..... 2014-208141

(51) Int. Cl.

| | |
|---|---|
| ***G04R 60/12*** | (2013.01) |
| ***H01Q 1/27*** | (2006.01) |
| ***G04B 19/247*** | (2006.01) |
| ***G04G 21/04*** | (2013.01) |
| ***H01Q 11/08*** | (2006.01) |

(52) U.S. Cl.

CPC ..... *G04R 60/12* (2013.01); *G04B 19/247* (2013.01); *G04G 21/04* (2013.01); *H01Q 1/273* (2013.01); *H01Q 11/08* (2013.01)

(58) Field of Classification Search

CPC ..... G04R 60/12; H01Q 1/273; H01Q 1/241; H01Q 11/08; G04G 21/04; G04B 19/247

USPC ..... 368/37, 278, 14, 280–281

See application file for complete search history.

(56) References Cited

U.S. PATENT DOCUMENTS

| | | | | |
|---|---|---|---|---|
| 6,853,605 | B2 * | 2/2005 | Fujisawa | G04B 37/0008 235/487 |
| 7,433,273 | B2 * | 10/2008 | Oguchi | G04C 3/008 368/46 |
| 9,377,763 | B2 * | 6/2016 | Fujisawa | G04R 60/06 |
| 2011/0102274 | A1 | 5/2011 | Fujisawa | |
| 2013/0051181 | A1 | 2/2013 | Fujisawa | |

FOREIGN PATENT DOCUMENTS

| | | | |
|---|---|---|---|
| JP | 2003-050983 | A | 2/2003 |
| JP | 2011-097431 | A | 5/2011 |
| JP | 2012-075091 | A | 4/2012 |
| JP | 2013-064723 | A | 4/2013 |
| JP | 2013-518498 | A | 5/2013 |
| WO | WO-2011-092498 | A1 | 8/2011 |

* cited by examiner

*Primary Examiner* — Edwin A. Leon

(74) *Attorney, Agent, or Firm* — Harness, Dickey & Pierce, P.L.C.

(57) ABSTRACT

An electronic timepiece has a case made at least in part from a conductive material and including a main case member and back cover and; a drive module disposed inside the case for displaying the time; a GPS antenna disposed inside the case around the drive module; and a crystal made from a non-conductive material and disposed to the opposite side of the case as the back cover. The GPS antenna is superimposed with the crystal in plan view, and not superimposed with parts of the main case on the crystal side of the GPS antenna.

7 Claims, 8 Drawing Sheets

ELECTRONIC TIMEPIECE

BACKGROUND

1. Technical Field

The present invention relates to an electronic timepiece with a built-in antenna for receiving radio frequency signals.

2. Related Art

Timepieces with radio frequency communication capabilities have become common. One example of such radio frequency communication functions is the ability to receive signals transmitted from GPS (Global Positioning System) or other positioning information satellites and detect the current location from the received signals.

Wristwatches having an antenna disposed inside the case and surrounding a drive module that drives a time display unit are one example of a timepiece with an RF receiver. The timepiece disclosed in JP-A-2013-64723, for example, effectively uses space inside the case to reduce the thickness of the timepiece compared with timepieces having the antenna disposed on the face side of the dial.

With the timepiece taught in JP-A-2013-64723, however, the outside circumference of the antenna is covered by the outside case of the timepiece, and the bezel covers the surface of the antenna on the face side of the timepiece. As a result, the outside case of the timepiece and the bezel will interfere with signals transmitted from positioning information satellites if they are made of metal or other conductive material, and receiving signals through the antenna is difficult. The outside case and bezel of the wristwatch disclosed in JP-A-2013-64723 are therefore made from ceramic, plastic, or other non-conductive material. This makes satisfying the desire to improve the appearance of the timepiece by using metal case members not possible.

SUMMARY

An objective of the present invention is therefore to provide a thin electronic timepiece with an improved appearance.

An electronic timepiece according to the invention includes: a main case including an outside case member made at least in part from a conductive material, and a back cover; a time display drive module disposed inside the case; a ring-shaped antenna disposed inside the case and around the drive module; and a cover member made at least in part from a non-conductive material and disposed on the opposite side of the main case as the back cover; the antenna being superimposed with the cover member in plan view at a position not overlapping any part of the main case on the cover member side of the antenna.

The main case may include a tubular outside case and bezel, or only the outside case member. The case is also not limited to configurations having an external case member and a separate back cover, and the external case member and back cover may have a one-piece construction.

Because the antenna does not overlap parts of the main case located on the cover member side of the antenna in plan view from the face side of the main case, radio waves passing from the face side of the timepiece through the cover member are incident to the antenna without being obstructed by the main case even if the main case is made from a conductive material.

The invention therefore enables making the main case and the back cover from metal or other conductive material without reducing reception performance, and can improve the appearance of the electronic timepiece.

Furthermore, because the antenna is disposed around the drive module, the timepiece can be made thinner than if the antenna is disposed on the face side of the dial.

In an electronic timepiece according to another aspect of the invention, the main case includes an outside case made of a conductive material, and a bezel disposed on the cover member side of the outside case, supporting the cover member, and made of a conductive material; the antenna disposed to a position not overlapping the outside case and bezel in plan view.

Because the antenna does not overlap the outside case and bezel in plan view, radio waves passing from the face side of the timepiece through the cover member are incident to the antenna without being obstructed by the outside case or bezel. The invention therefore enables making the main case, bezel, and back cover from metal or other conductive material without reducing reception performance, and can improve the appearance of an electronic timepiece with a bezel.

In addition, because the bezel is made from a conductive material, processing is easier and the freedom of design can be improved compared with using ceramic materials, and the cost can be reduced.

Furthermore, when a metal bezel is used, rigidity can be assured with a smaller sectional area than when a ceramic bezel is used. The sectional width of the ring-shaped bezel can therefore be reduced, the planar size of the cover member can be increased, and the freedom of timepiece design can be improved.

An electronic timepiece according to another aspect of the invention preferably also has a calendar wheel made from a non-conductive material disposed to a position on the cover member side of the antenna at a position not superimposed with the antenna in plan view.

Because the date wheel, day wheel, or other calendar wheel is made from a non-conductive material in this aspect of the invention, radio wave can pass through the calendar wheel and be picked up by the antenna even if the calendar wheel is superimposed with the antenna in plan view, and a drop in reception performance can be prevented.

Furthermore, because the calendar wheel can be superimposed with the antenna in plan view, the planar size of the timepiece can be reduced compared with configurations having the calendar wheel on the outside of the antenna.

Further preferably, an electronic timepiece according to another aspect of the invention also has a solar panel disposed to a position on the cover member side of the drive module at a position not overlapping the antenna in plan view.

By thus disposing the solar panel inside the antenna in plan view, the solar panel can be disposed to a position superimposed with the drive module and not superimposed with the antenna.

The solar panel includes electrodes, but because the antenna and the solar panel do not overlap in plan view in the invention, radio waves travelling from the face side of the timepiece are incident to the antenna without being obstructed by the solar panel. As a result, a solar panel can be disposed in an electronic timepiece without reducing reception performance.

Further preferably in an electronic timepiece according to another aspect of the invention, the antenna has a dielectric substrate and an antenna electrode formed on the dielectric substrate, and the dielectric substrate has a through-passage through which an operator used to operate the electronic timepiece passes.

An operator as used herein is a winding stem that rotates in unison with the crown or a button, and the through-passage is a channel or a hole in the dielectric member.

By thus passing the operator through the through-passage, the operator can reach from outside the antenna to the drive module disposed inside the antenna.

As a result, interference between the antenna and the operator can be avoided. The antenna and the operator can therefore be disposed at the same height in the height direction of the main case, there is no need to dispose the antenna and the operator at different heights, and the timepiece can be made thinner.

An electronic timepiece according to another aspect of the invention preferably also has a wireless communication unit connected to the antenna; the main case including an outside case, and the outside case and the back cover being made of a conductive material and connected to the ground of the wireless communication unit.

In this aspect of the invention, the outside case and back cover made from conductive materials are connected to the ground of the wireless communication unit, and therefore function as a ground plane. As a result, the surface area of the ground plane can be increase, antenna gain can be improved, and antenna characteristics improved.

An electronic timepiece according to another aspect of the invention preferably also has a dial made from a non-conductive material and disposed to the cover member side of the drive module and antenna; and a ring member made from a non-conductive material and disposed to the cover member side of the dial.

The ring member may be a dial ring disposed around the edge of the dial.

Because the ring member and dial are made from non-conductive materials, even if the antenna is superimposed with the ring member and dial in plan view, radio waves passing through from the face side of the timepiece pass through the ring member and dial and are incident to the antenna.

As a result, the ring member can be disposed overlapping the antenna in plan view, and the planar size of the timepiece can be reduced compared with a configuration having the ring member disposed on the outside side of the antenna.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
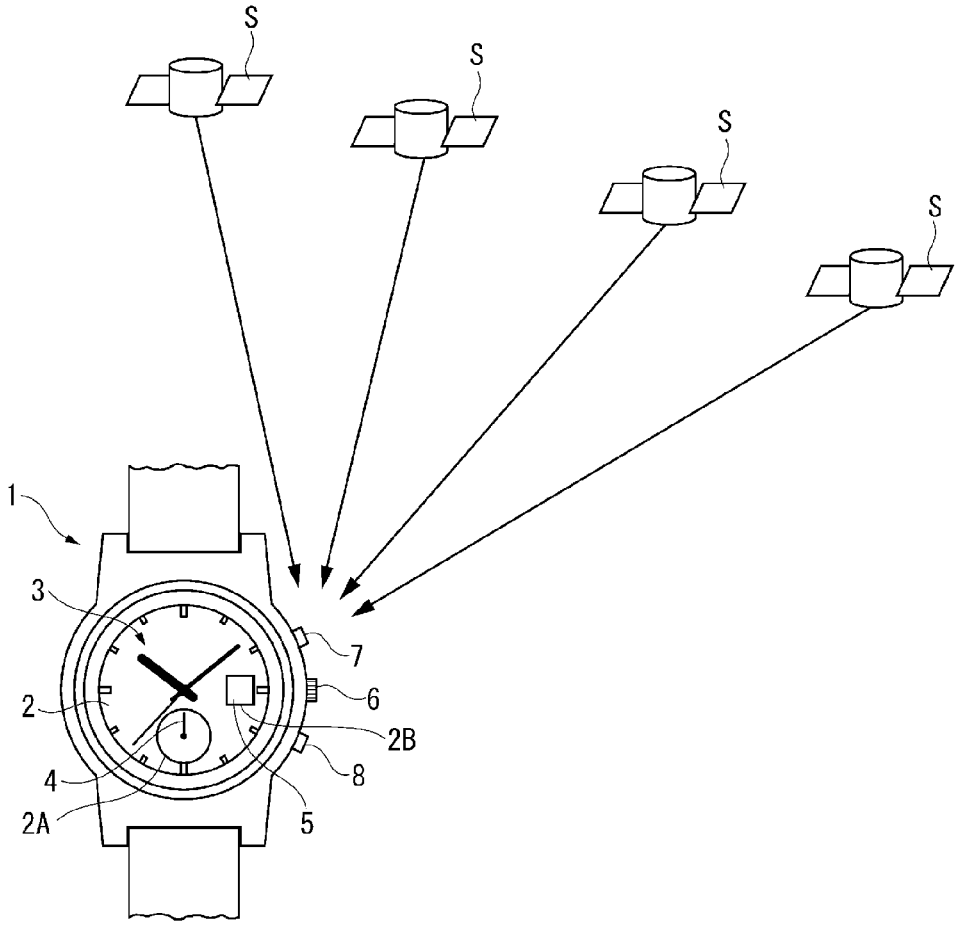
FIG. 1 illustrates an electronic timepiece according to the invention.

As shown in FIG. 1, an electronic timepiece 1 according to this embodiment of the invention is a wristwatch with a time display unit for displaying the time using a dial 2 and hands 3, an information display unit including a subdial 2A of the dial 2 and a hand 4 for indicating information such as the timekeeping mode, day, and reserve power, and a calendar display unit including a window 2B in the dial 2 and a date wheel 5.

The dial 2 is a disc-shaped member made of a non-conductive material.

The hands 3 include a second hand, minute hand, and hour hand. The hands 3, 4 and date wheel 5 are driven by a drive mechanism including a stepper motor and wheel train described further below. Note that because the hands 3, 4 occupy only a small area, there is no interference with signal reception even if the hands are metal, but the hands are preferably made from a non-conductive material because any interference with signal reception can be avoided.

The electronic timepiece 1 receives satellite signals and acquires satellite time information from the plural GPS satellites S orbiting the Earth on known orbits, and can correct internal time information based on the acquired satellite time information.

Note that the GPS satellites S shown in FIG. 1 are just one example of positioning information satellites, and numerous GPS satellites S are in orbit. There are presently approximately 30 GPS satellites S in service.

The electronic timepiece 1 also has a crown 6 and buttons 7 and 8 as external operating members.

External Structure of the Electronic Timepiece

Figure 2:
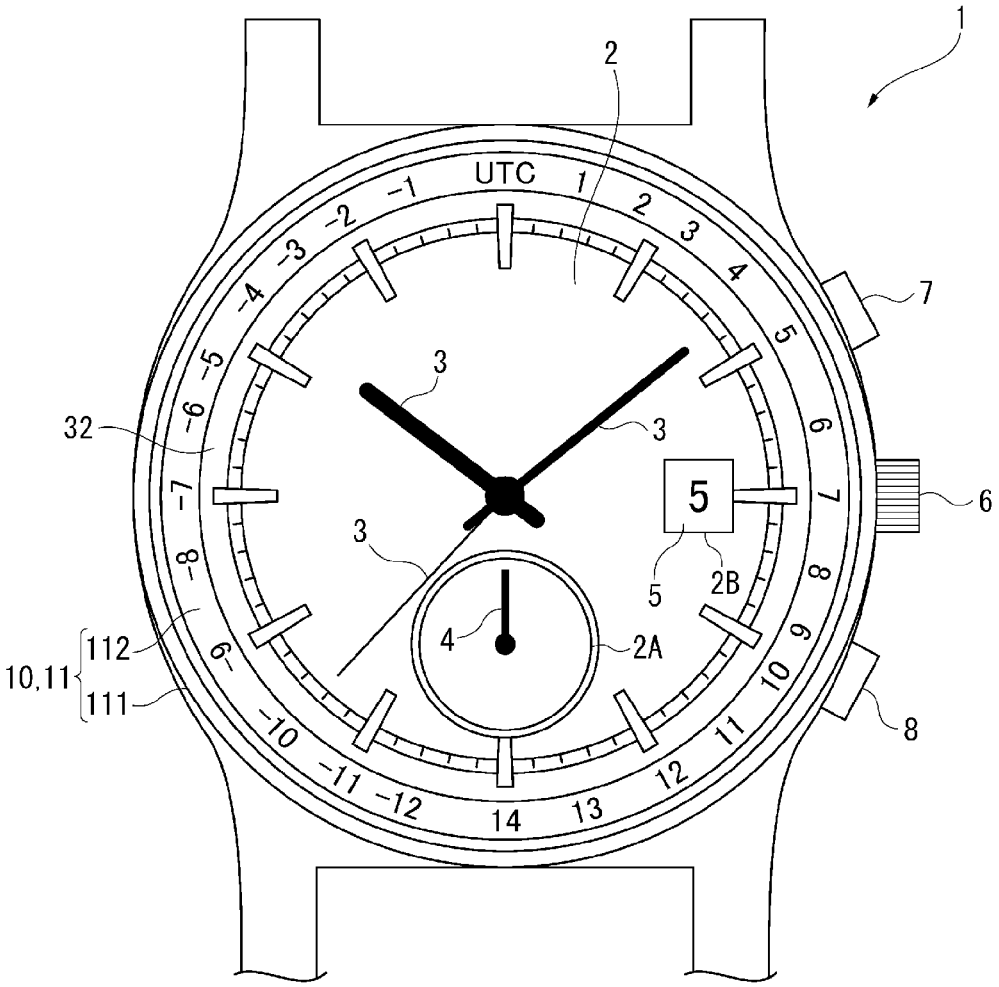
FIG. 2 is a plan view of the electronic timepiece.
Figure 3:
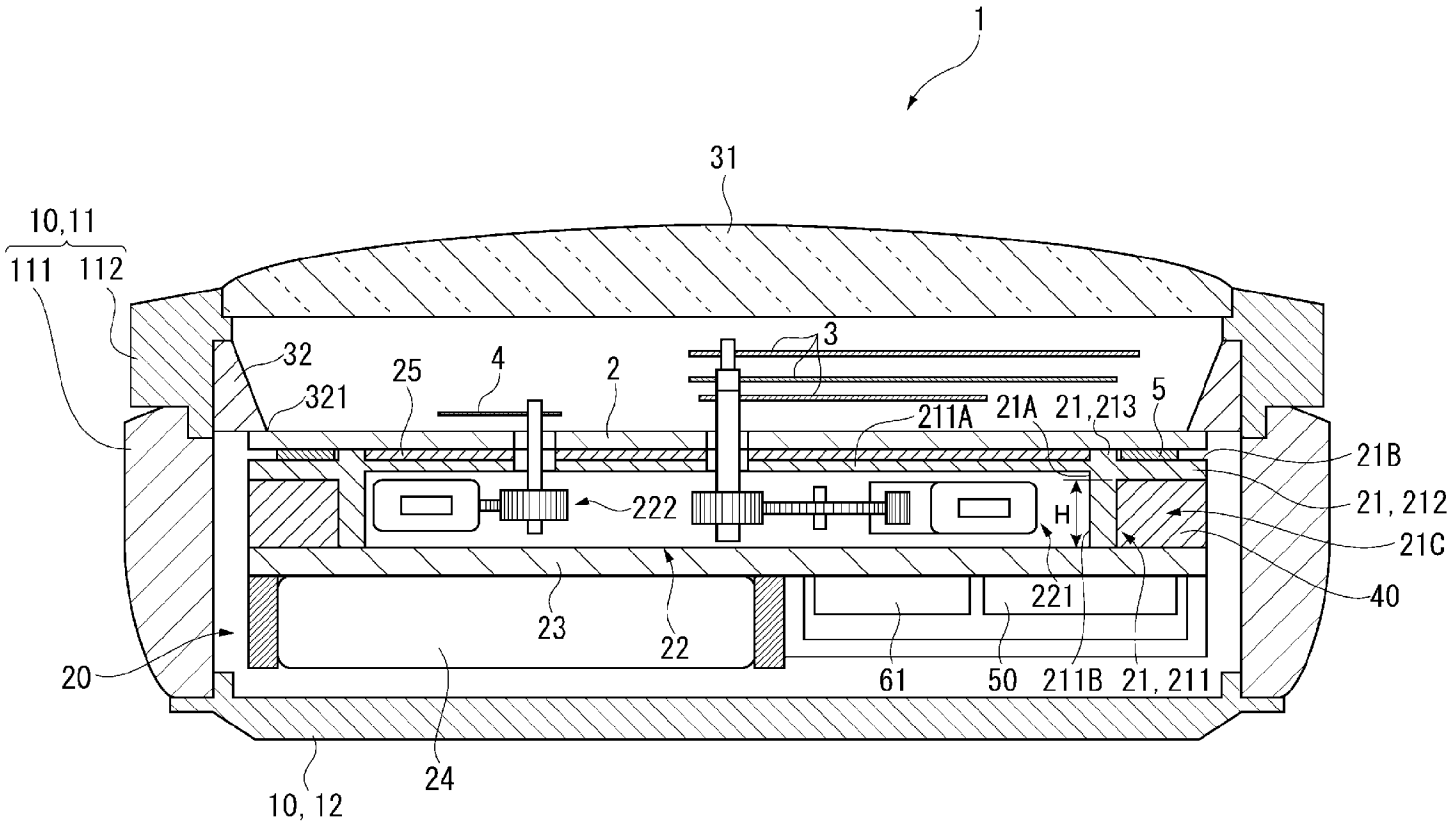
FIG. 3 is a section view of the electronic timepiece.

As shown in FIG. 2 and FIG. 3, the electronic timepiece 1 has a case 10 that houses a movement 20 described further below. The case 10 includes the main case 11, and the back cover 12.

The main case 11 includes a tubular outside case member 111, and a bezel 112 disposed on the front side of the outside case member 111.

Note that the front side denotes the top of the timepiece (the same side as the crystal), and the back side denotes the bottom of the timepiece (the back cover side).

The bezel 112 is shaped like a ring with the outside of the bezel 112 continuous to the outside of the outside case member 111. The bezel 112 and outside case member 111 are connected by an interlocking tongue-and-groove structure formed on their mutual opposing surfaces, or by adhesive or double-sided adhesive tape, for example. The bezel 112 may also be attached so that it can rotate on the outside case member 111.

The crystal 31 is attached to the inside of the bezel 112 as a cover member held by the bezel 112. The crystal 31 is made of a non-conductive material such as sapphire glass. Note that the crystal is not limited to glass, and may be made of plastic, for example.

A round back cover 12 is disposed to the back of the outside case member 111 covering the back cover side opening in the outside case member 111. The back cover 12 and the outside case member 111 screw together.

Note that the outside case member 111 and the back cover 12 are discrete members in this embodiment of the invention, but the invention is not so limited and the outside case member 111 and back cover 12 may be formed in unison as a single piece.

The outside case member 111, bezel 112, and back cover 12 are made of brass, stainless steel, titanium alloy, or other conductive metal material.

Note also that the outside case member 111 and the back cover 12 are connected to the ground of the reception module 50 of the movement 20 described below.

Internal Configuration of the Electronic Timepiece

The internal structure housed in the case 10 of the electronic timepiece 1 is described next.

Figure 4:
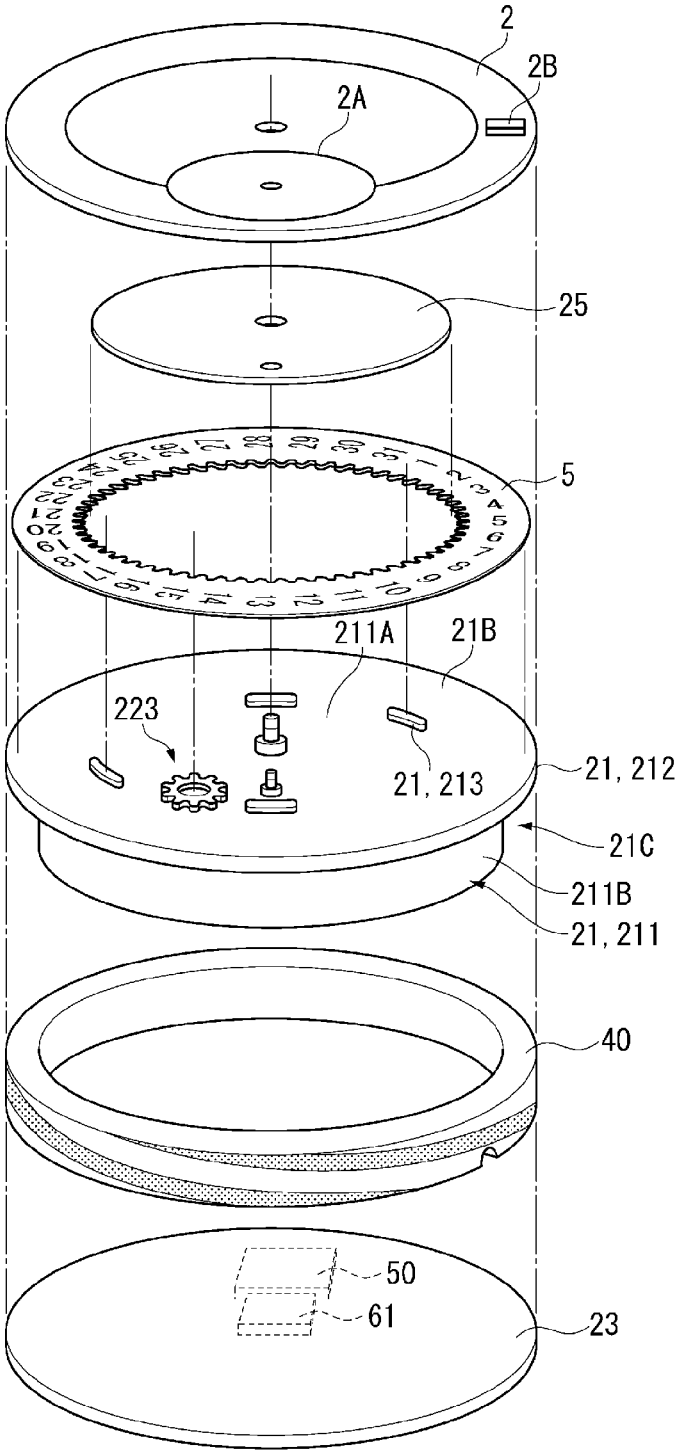
FIG. 4 is a partially exploded oblique view of the electronic timepiece.

As shown in FIG. 2, FIG. 3, and FIG. 4, the dial 2, movement 20, GPS antenna 40, date wheel 5, and dial ring 32 are housed inside the case 10.

The movement 20 includes the base plate 21, a drive module 22 supported by the base plate 21, a circuit board 23, a storage battery 24, and a solar panel 25.

The base plate 21 is made from plastic or other non-conductive material. The base plate 21 has a main part 211 including a flat part 211A including a drive module housing 21A that holds the drive module 22, and a wall member 211B disposed at the outside of the flat part 211A surrounding the drive module housing 21A. The base plate 21 also has an outside flange 212 extending to the outside from the top of the wall member 211B, and a plurality of guide parts 213 that protrude up from the top of the wall member 211B. The outside flange 212 is ring-shaped in plan view.

A date wheel housing 21B in which the date wheel 5 is disposed is disposed on the face side of the outside flange 212, which is located outside the plural guide parts 213. Movement in the plane direction of the date wheel 5 disposed in the date wheel housing 21B is limited by the guide parts 213.

The drive module 22 is held in the drive module housing 21A of the base plate 21, and drives the time display unit, information display unit, and calendar display unit. More specifically, the drive module 22 includes a drive mechanism 221 with a stepper motor and wheel train for driving the hands 3, a drive mechanism 222 with a stepper motor and wheel train for driving the small hand 4, and a drive mechanism 223 including a stepper motor and wheel train for driving the date wheel 5 (see FIG. 4).

The circuit board 23 is disposed on the back side of the base plate 21 superimposed with the main part 211 and outside flange 212 in plan view. More specifically, the circuit board 23, main part 211, and outside flange 212 are stacked together in the thickness direction of the timepiece.

The top side of the circuit board 23 contacts the back side of the wall member 211B of the base plate 21, and is attached to the base plate 21 by screw or other fastener. The back side of the outside flange 212 and the front side of the circuit board 23 facing the back side of the outside flange 212 are separated by the height H of the wall member 211B located on the circuit board 23 side of the outside flange 212.

The space thus formed between the back of the outside flange 212 and the front of the circuit board 23 is used as an antenna housing 21C to hold the GPS antenna 40.

A reception module 50 (embodying the wireless communication unit of the invention) that processes satellite signals received from GPS satellites S, and a control unit 61 that controls the drive mechanisms 221 to 223, are mounted on the back side of the circuit board 23. Because the reception module 50 and control unit 61 are located on the opposite side of the circuit board 23 as the GPS antenna 40, signals received by the GPS antenna 40 are protected from noise produced by the reception module 50 and control unit 61.

A lithium ion battery is used for the storage battery 24. The storage battery 24 supplies power to the drive module 22, reception module 50, and control unit 61. The storage battery 24 is also disposed to the back side of the circuit board 23 at a position not overlapping the reception module 50 and control unit 61 in plan view.

The solar panel 25 is round and is disposed on the face side of the flat part 211A of the base plate 21. The solar panel 25 has a photovoltaic layer made from amorphous silicon, and transparent electrodes made from indium tin oxide (ITO), for example, formed in layers on a substrate made from a plastic film.

A ring-shaped GPS antenna 40 (embodying the antenna of the invention) is disposed in the antenna housing 21C. The GPS antenna 40 is thus disposed around the drive module 22.

The GPS antenna 40 is affixed to the surface of the circuit board 23. The thickness of the GPS antenna 40 is substantially equal to the height of the antenna housing 21C.

The GPS antenna 40 is disposed around the outside of the solar panel 25 in plan view, and is not superimposed with the solar panel 25. In other words, the solar panel 25 is disposed inside the GPS antenna 40 in plan view.

The GPS antenna 40 is also disposed inside the main case 11 (outside case member 111 and bezel 112), and is not superimposed with the main case 11 in plan view. More specifically, the GPS antenna 40 is not superimposed with any parts of the main case 11 on the face side or the back cover side of the GPS antenna 40. In other words, the outside circumference of the GPS antenna 40 is inside the inside circumference of the main case 11.

The GPS antenna 40 receives satellite signals transmitted from GPS satellites S. This GPS antenna 40 is described in detail below.

The date wheel 5, which is a ring-shaped calendar wheel having date numbers displayed on the surface, is held in the date wheel housing 21B of the base plate 21. The date wheel 5 is made from plastic or other non-conductive material. In plan view, the date wheel 5 overlaps at least part of the GPS antenna 40. Note that the calendar wheel is not limited to a date wheel 5, and may be a day wheel showing the days of the week, or a month wheel showing the months.

The dial 2 is disposed to the face side of the base plate 21 covering the solar panel 25 and the date wheel 5. The dial 2 is made from a material such as plastic that is non-conductive and transparent to at least some light.

Abbreviations or other markings such as a ring decorating the area around the subdial 2A can be disposed to the surface of the dial 2 overlapping the GPS antenna 40 in plan view. To improve the reception performance of the GPS antenna 40, these parts are preferably made from plastic or other non-conductive material instead of metal.

Because the dial 2 is transparent to light, the solar panel 25 located on the back side of the dial 2 can be seen through the dial 2 from the front of the timepiece. The color of the dial 2 appears different in the areas where the solar panel 25 is present and where the solar panel 25 is not present. Design accents may be added to the dial 2 so that this color different is not conspicuous.

A dial ring 32 that is a ring shaped member made of a plastic non-conductive material is disposed to the face side of the dial 2. The dial ring 32 is disposed around the circumference of the dial 2, is conically shaped with the inside circumference surface sloping down to the dial 2, and has 60 minute markers printed on the inside sloping surface.

Note that this ring member is not limited to a dial ring, and may be another ring-shaped member disposed around the outside of the dial 2.

The dial ring 32 is superimposed with at least part of the GPS antenna 40 in plan view. More specifically, the bottom end 321 (the end on the back cover side) of the slope of the dial ring 32 covers part of the GPS antenna 40 in plan view.

The dial ring 32 is held pressed against the dial 2 by the bezel 112.

As described above, in plan view, the GPS antenna 40 does not overlap the main case 11 (outside case member 111 and bezel 112) and solar panel 25, but does overlap the outside flange 212 of the base plate 21, the date wheel 5, the dial 2, the dial ring 32, and the crystal 31, which are made from non-conductive materials. More specifically, all parts of the electronic timepiece 1 that cover the face side of the GPS antenna 40 in plan view are made from non-conductive materials.

As a result, after passing through the crystal 31, satellite signals passing from the face side of the timepiece pass through the dial ring 32, dial 2, date wheel 5, and outside flange 212 without interference from the main case 11 or solar panel 25, and are incident to the GPS antenna 40.

GPS Antenna

GPS satellites S transmit right-hand circularly polarized satellite signals. An antenna designed for use with circularly polarized waves is more efficient as a GPS antenna than an antenna designed for receiving linearly polarized waves.

Figure 5:
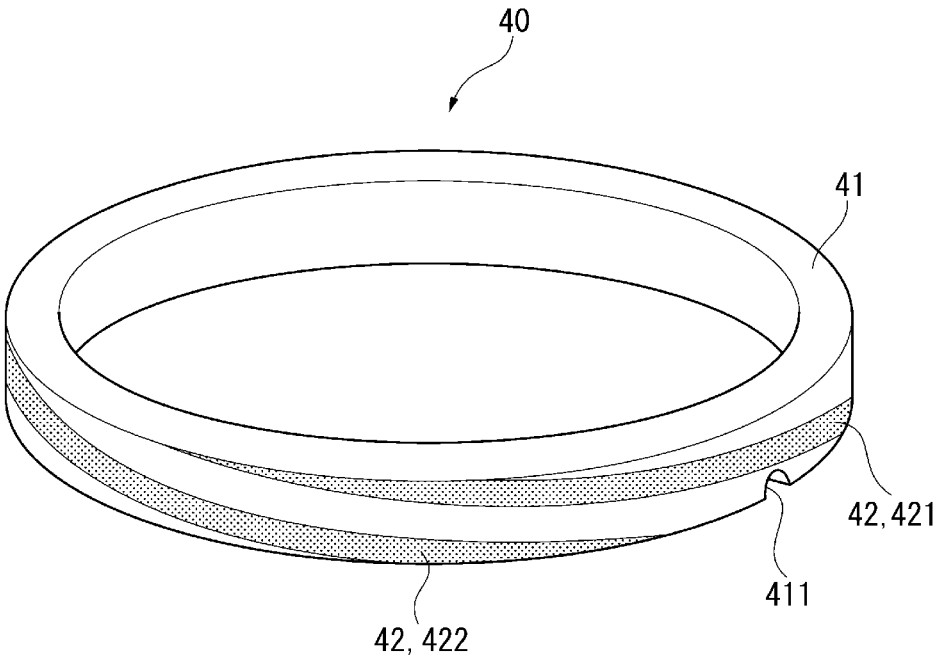
FIG. 5 is an oblique view illustrating the GPS antenna of the electronic timepiece according to this embodiment of the invention.

As shown in FIG. 5, the GPS antenna 40 according to this embodiment is a helical antenna with four antenna elements.

The GPS antenna 40 has a ring-shaped dielectric substrate 41 with antenna electrodes 42 formed on the outside circumference.

The dielectric substrate 41 is 2 mm to 3 mm thick, and has a dielectric constant □$_r$ of 6-15. The dielectric substrate 41 may be made with a dielectric material that can be used at high frequencies, such as ceramic or titanium oxide, mixed with plastic.

A through-passage 411 through which the winding stem of the crown 6, which is an operator for operating the timepiece, passes is disposed to the dielectric substrate 41. This through-passage 411 is a channel or groove formed in the back surface of the dielectric substrate 41.

Note that openings for inserting the stems of operators such as the buttons 7 and 8 may also be formed in the dielectric substrate 41. The through-passage 411 is also not limited to a channel, and may be a hole passing through the dielectric substrate 41.

The antenna electrode 42 is formed in unison with the dielectric substrate 41 by forming conductive metal elements of copper or silver, for example, in lines on the outside circumference surface of the dielectric substrate 41 by electroless plating or printing.

The antenna electrode 42 includes four antenna elements (of which only the two antenna elements 421, 422 are shown in the figure). The antenna elements are disposed with one end of each evenly spaced along the outside circumference from the back side of the dielectric substrate 41 (not shown in the figure). Each antenna element continues from the back side of the dielectric substrate 41 along the outside circumference surface in a half-spiral along the outside circumference surface with the other end of each element ending at the face-side end of the outside circumference surface.

A helical antenna thus comprised radiates circularly polarized waves along the axis (the thickness direction of the dielectric substrate 41), and desirably receives satellite signals passed from the face side of the timepiece.

A helical antenna is an unbalanced antenna and requires a ground plane. As a result, the GPS antenna 40 in this embodiment of the invention is disposed on the face side of the circuit board 23, and the end of each antenna element on the back side of the dielectric substrate 41 connects to the ground of the circuit board 23, making the circuit board 23 function as the ground plane of the GPS antenna 40.

As described above, the outside case member 111 and back cover 12 in this embodiment of the invention are made of conductive materials, and connect to the ground of the reception module 50. As a result, the outside case member 111 and back cover 12 also function as a ground plane for the GPS antenna 40.

Circuit Configuration of the Electronic Timepiece

The circuit design of the electronic timepiece 1 is described next with reference to FIG. 6.

Figure 6:
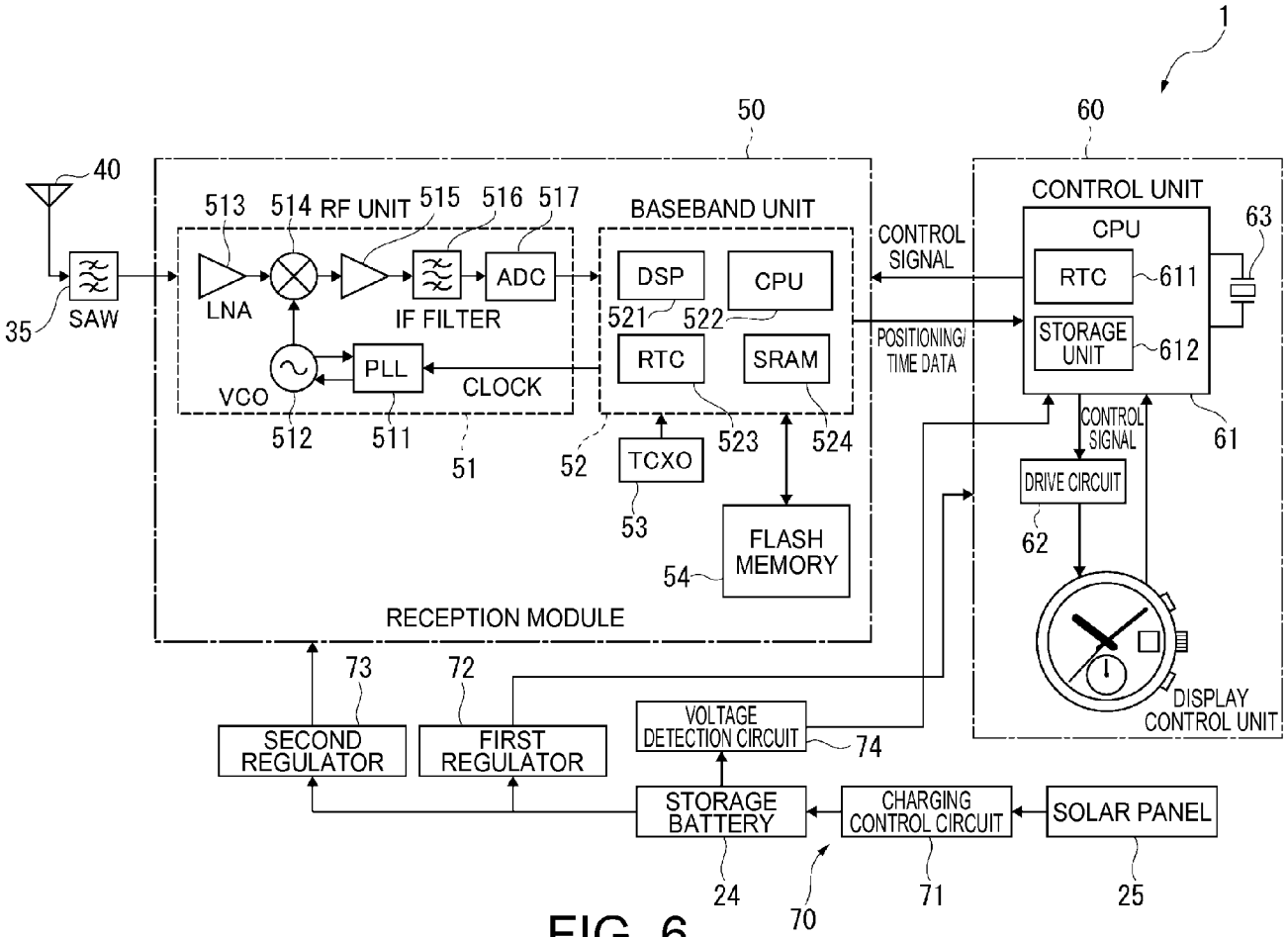
FIG. 6 is a block diagram illustrating the hardware configuration of an electronic timepiece according to this embodiment of the invention.

As shown in FIG. 6, the electronic timepiece 1 has a GPS antenna 40, a SAW filter 35, the reception module 50, a display control unit 60, and a power supply unit 70.

The SAW filter 35 is a bandpass filter that passes signals in the 1.5 GHz waveband. A LNA (low noise amplifier) may also be disposed between the GPS antenna 40 and the SAW filter 35 to improve reception sensitivity.

Note also that the SAW filter 35 may be embedded in the reception module 50.

The reception module 50 processes satellite signals passed through the SAW filter 35, and includes an RF (radio frequency) unit 51 and a baseband unit 52.

The RF unit 51 includes a PLL (phase-locked loop) circuit 511, a VCO (voltage controlled oscillator) 512, a LNA (low noise amplifier) 513, a mixer 514, an IF (intermediate frequency) amplifier 515, an IF filter 516, and an A/D converter 517.

The satellite signal passed by the SAW filter 35 is amplified by the LNA 513, mixed by the mixer 514 with the clock signal output by the VCO 512, and down-converted to a signal in the intermediate frequency band.

The IF signal from the mixer 514 is amplified by the IF amplifier 515, passed through the IF filter 516, and converted to a digital signal by the A/D converter 517.

The baseband unit 52 includes, for example, a DSP (digital signal processor) 521, CPU (central processing unit) 522, a RTC (real-time clock) 523, and SRAM (static random access memory) 524. A TCXO (temperature compensated crystal oscillator) 53 and flash memory 54 are also connected to the baseband unit 52.

A digital signal is input from the A/D converter 517 of the RF unit 51 to the baseband unit 52, which acquires satellite time information and navigation information by a correlation process and positioning computation process.

Note that the clock signal for the PLL circuit 511 is generated by the TCXO 53.

The display control unit 60 includes a control unit (CPU) 61, a drive circuit 62 that drives the hands 3, 4, a time display unit, and information display unit.

The control unit 61 includes a RTC 611 and storage unit 612.

The RTC 611 calculates the internal time information using a reference signal output from a crystal oscillator 63.

The storage unit 612 stores the satellite time information and positioning information output from the reception module 50. Time difference data corresponding to the positioning information is also stored in the storage unit 612, and the local time at the current location can be calculated from the time difference data and the internal time kept by the RTC 611.

The electronic timepiece 1 in this example can also automatically correct the displayed time based on the satellite signals received from the GPS satellites S using the reception module 50 and display control unit 60 described above.

The power supply unit 70 includes the solar panel 25, a charging control circuit 71, the storage battery 24, a first regulator 72, a second regulator 73, and a voltage detection circuit 74.

When light is incident and the solar panel 25 produces power, the power obtained by photovoltaic generation is passed by the charging control circuit 71 to the storage battery 24 to charge the storage battery 24.

The storage battery 24 supplies drive power through the first regulator 72 to the display control unit 60, and supplies power through the second regulator 73 to the reception module 50.

The voltage detection circuit 74 monitors the output voltage of the storage battery 24, and outputs to the control unit 61. The control unit 61 can therefore control the reception process based on the voltage of the storage battery 24.

Operating Effect

Because the GPS antenna 40 does not overlap the main case 11 (outside case member 111 and bezel 112) in plan view when seen from the face of the timepiece, satellite signals pass from the face side of the timepiece through the crystal 31 and are incident to the GPS antenna 40. Metal or other conductive material can therefore be used for the main case 11 and back cover 12 without reducing reception performance, and the apparent quality of the electronic timepiece 1 can be improved.

Furthermore, because the GPS antenna 40 is disposed around the drive module 22, the timepiece can be made thinner than when the GPS antenna 40 is on the face side of the dial 2, for example.

Furthermore, because the bezel 112 is made from a conductive material, the bezel 112 can be manufactured more easily than when using ceramic, freedom of design can therefore be improved, and cost can be reduced. Furthermore, because the bezel 112 is metal, greater rigidity can be achieved in a smaller sectional area than with a ceramic bezel. The sectional width of the ring-shaped bezel 112 can therefore be reduced, the planar size of the crystal 31 can be increased, and the freedom of timepiece design can be improved.

Furthermore, because the date wheel 5 is a non-conductive member, satellite signals can pass through the date wheel 5 and be picked up by the antenna even if the date wheel 5 is superimposed with the GPS antenna 40 in plan view, and a drop in reception performance can be prevented.

Furthermore, because the date wheel 5 overlaps the GPS antenna 40 in plan view, the planar size of the timepiece can be reduced compared with a configuration having the date wheel 5 disposed around the outside of the GPS antenna 40.

Furthermore, because the GPS antenna 40 does not overlap the solar panel 25 in plan view, satellite signals travelling from the face side of the timepiece are incident to the GPS antenna 40 without being obstructed by the solar panel 25. A solar panel 25 can therefore be provided in the electronic timepiece 1 without reducing reception performance.

Because the winding stem can reach from the outside of the GPS antenna 40 to the drive module 22 by passing the winding stem through the through-passage 411 in the dielectric substrate 41, the GPS antenna 40 can be prevented from interfering with the winding stem. As a result, the GPS antenna 40 and the winding stem can be disposed at the same height in the thickness direction of the timepiece, and the timepiece can be made thin because there is no need to dispose the GPS antenna 40 and the winding stem at different heights.

The outside case member 111 and back cover 12 can also function as a ground plane because they are connected to the ground of the reception module 50. The surface area of the ground plane can therefore be increased, antenna gain improved, and antenna performance improved.

Furthermore, because the dial ring 32 is made from a non-conductive material, the dial ring 32 can be disposed superimposed in plan view with the GPS antenna 40, and the planar size of the timepiece can be reduced compared with a configuration having the dial ring 32 outside of the GPS antenna 40.

If parts made from non-conductive materials are disposed near the antenna electrode 42, the reception frequency of the GPS antenna 40 may change according to the distance to those parts.

Because the GPS antenna 40 is fixed to the circuit board 23 and the circuit board 23 touches the back end of the wall member 211B of the base plate 21 in this embodiment, a constant distance can be assured between the antenna electrode 42 of the GPS antenna 40 and the outside flange 212 of the base plate 21 on the face side of the GPS antenna 40. Deviation in this gap between timepieces can therefore be suppressed, and a specific reception frequency can be assured in individual timepieces. Adjusting the reception frequency of individual timepieces after the timepiece is assembled is therefore not necessary.

Other Embodiments

The invention is not limited to the embodiment doves, and can be varied in many ways without departing from the technical scope of the invention.

A helical antenna is used as the GPS antenna 40 in the foregoing embodiment, but the invention is not so limited and a loop antenna, for example, may be used.

Figure 7:
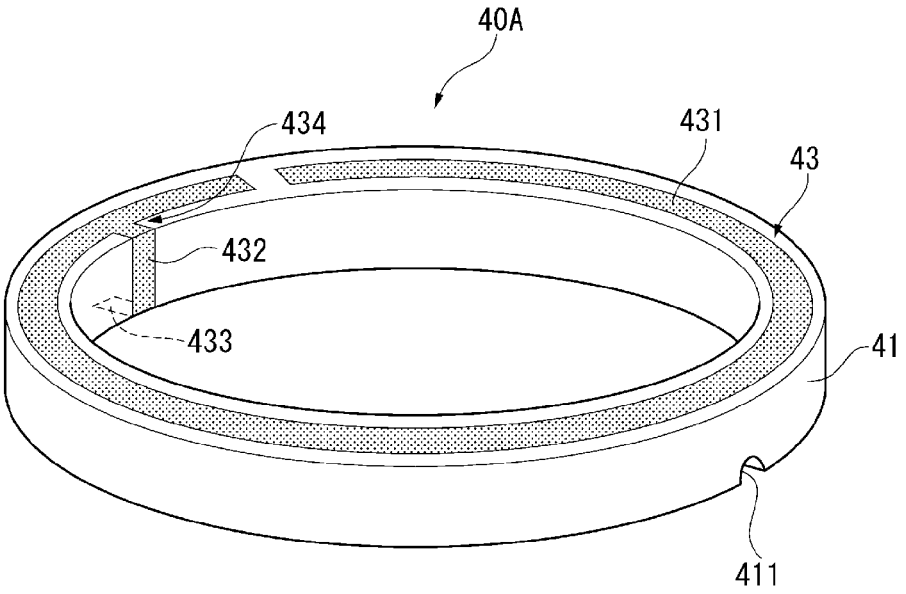
FIG. 7 is an oblique view illustrating the GPS antenna of an electronic timepiece according to another embodiment of the invention.

As shown in FIG. 7, a GPS antenna 40A according to this embodiment of the invention has an antenna electrode 43 formed on the surface of the dielectric substrate 41. The antenna electrode 43 has an antenna lead 431, coupling 432, and feed 433.

The antenna lead 431 is a C-shaped member formed on the surface of the dielectric substrate 41, and receives satellite signals incident thereto from the crystal 31 side. The length of the antenna lead 431 is equal to approximately one wavelength of the satellite signal after wavelength shortening by the dielectric substrate 41. A connection node 434 is formed at one place on the inside circumference of the antenna lead 431, and the coupling 432 is formed from this connection node 434 to the inside circumference surface of the dielectric substrate 41. The opposite end of the coupling 432 as the connection node 434 extends toward the back side of the dielectric substrate 41, and a feed 433 contiguous to the coupling 432 is formed on the back cover side of the dielectric substrate 41. This feed 433 is connected to the circuit board 23.

Satellite signals can also be desirably received by the GPS antenna 40A in this embodiment of the invention.

The main case 11 in the foregoing embodiments includes an outside case member 111 and bezel 112, but the invention is not so limited. More specifically, the main case 11 may comprise only the outside case member 111.

Figure 8:
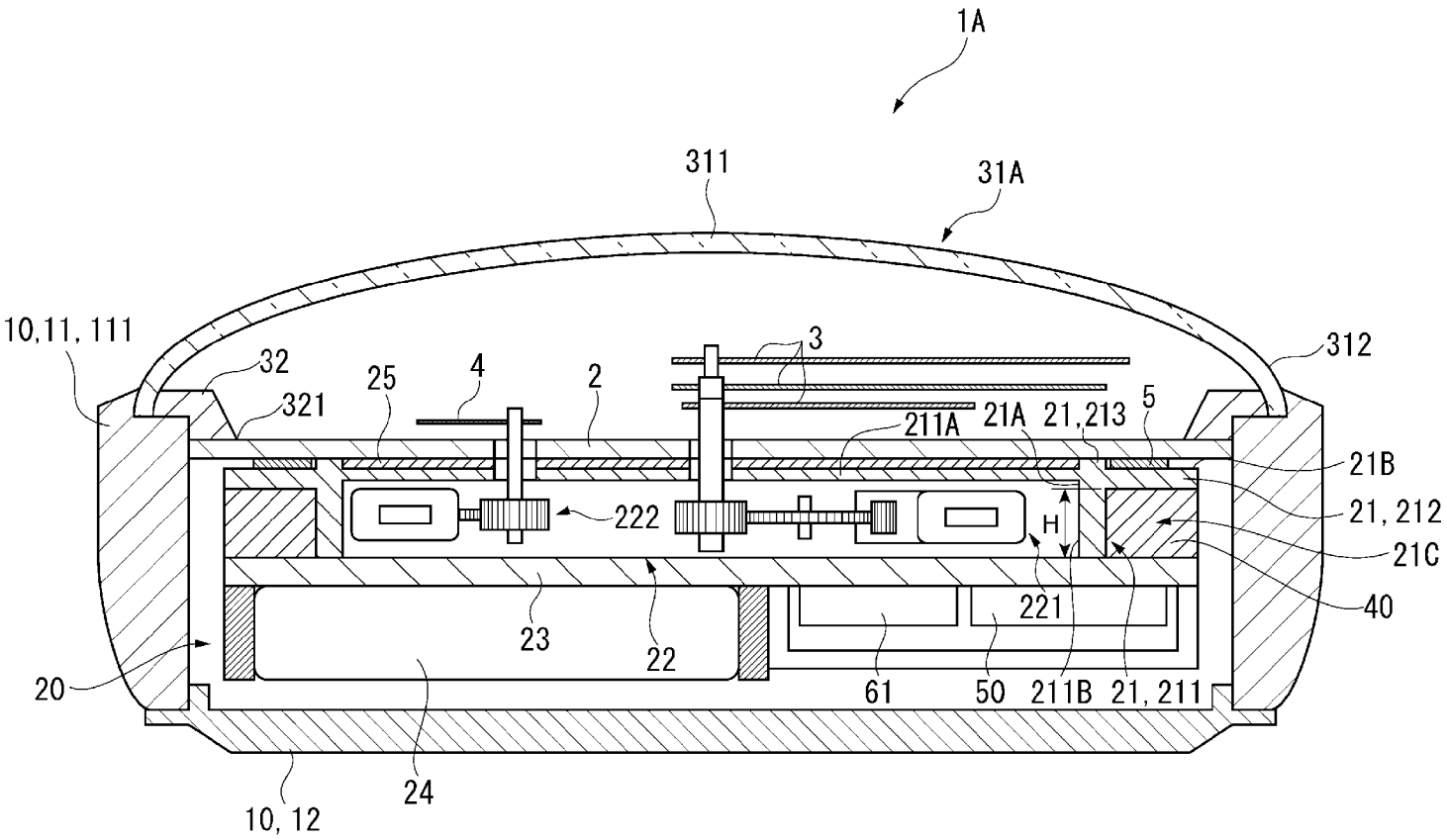
FIG. 8 is a section view of an electronic timepiece according to another embodiment of the invention.

As shown in FIG. 8, the crystal 31A of the electronic timepiece 1A in this embodiment of the invention can be manufactured by cutting and polishing plate glass, for example, into a dome shaped configuration having a surface portion 311 covering the dial side of the timepiece, and a tubular side portion 312 along the outside edge of the surface portion 311. The crystal 31A is attached to the outside case member 111 by fitting the side portion 312 into a shoulder formed on the face-side end of the outside case member 111.

The outside case member 111 holds the dial ring 32 pressed against the dial 2 through the side portion 312 of the crystal 31A.

This embodiment of the invention achieves the same effect as described above because the GPS antenna 40 is disposed superimposed with the crystal 31A without overlapping the outside case member 111 in plan view.

The antenna electrode 42 is formed on the outside circumference surface of the GPS antenna 40 in this embodiment of the invention, but the invention is not so limited. For example, the antenna electrode 42 may be formed on the inside circumference surface of the GPS antenna 40. In this configuration, the distance between the antenna electrode 42 and the main case 11 is greater than when the antenna electrode 42 is on the outside circumference surface of the GPS antenna 40. As a result, a drop in the performance of the GPS antenna 40 due to obstruction of the satellite signals by the main case 11 can be suppressed.

The GPS antenna is not superimposed in plan view with any part (parts on the face side or back cover side of the GPS antenna in satellite number SV) of the main case 11, but the invention is not so limited. More specifically, because the GPS antenna must be able to receive satellite signals incident from the face side of the timepiece, the GPS antenna must not be superimposed with any part of the main case 11 on the face side of the GPS antenna.

The bezel 112 in the foregoing embodiment is made from a conductive material, but the invention is not so limited. For example, the bezel 112 may be made of a ceramic such as zirconia ($ZrO_2$), which is a non-conductive material. Zirconia has high resistivity, does not adversely affect signal reception, is hard, offers excellent scratch resistance, and is outstanding when used as an external member of a timepiece.

The electronic timepiece 1 in the foregoing embodiments has a date wheel 5, solar panel 25, and dial ring 32, but the invention is not so limited. More specifically, the electronic timepiece may be made without a date wheel 5, solar panel 25, and dial ring 32.

A through-passage 411 through which a winding stem passes is disposed in the dielectric substrate 41 in the foregoing embodiments, but the invention is not so limited. For example, the through-passage 411 is not needed if the GPS antenna and the winding stem are not at the same height in the thickness direction of the timepiece.

The outside case member 111 and back cover 12 are connected to the ground of the reception module 50 in the foregoing embodiments, but the invention is not so limited. More specifically, the outside case member 111 and back cover 12 do not need to be connected to the ground.

The electronic timepiece in the foregoing embodiments has a time display unit comprising a dial 2 and hands 3, but the invention is not so limited. The electronic timepiece may be made with an LCD panel as the time display unit, for example. In this event, the drive module that drives the time display unit may be a drive unit that drives the LCD panel.

In this case, the electronic timepiece simply requires a time display function, and the time display unit need not be a display unit for displaying only the time. Examples of such electronic timepieces are wrist-wearable devices such as heart rate monitors that are worn on the user's wrist to measure the heart rate, and GPS loggers that are worn on the wrist and measure the user's current location while the user is jogging.

The foregoing embodiments are described with reference to a GPS satellite as an example of a positioning information satellite, but the positioning information satellite of the invention is not limited to GPS satellites and the invention can be used with Global Navigation Satellite Systems (GNSS) such as Galileo (EU), GLONASS (Russia), and Beidou (China). The invention can also be used with geostationary satellites in satellite-based augmentation systems (SBAS), and quasi-zenith satellites in radio navigation satellite systems (RNSS) that can only search in specific regions. The invention can also be used in configurations that receive and process satellite signals from multiple systems.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2014-208141, filed Oct. 9, 2014 is expressly incorporated by reference herein.

What is claimed is:

1. An electronic timepiece comprising:

a main case including an outside case member made at least in part from a conductive material, and a back cover;

a time display drive module disposed inside the case;

a ring-shaped antenna disposed inside the case and around the drive module; and a cover member made at least in part from a non-conductive material and disposed on the opposite side of the main case as the back cover;

the antenna being superimposed with the cover member in plan view at a position not overlapping any part of the main case on the cover member side of the antenna.

2. The electronic timepiece described in claim 1, wherein:

the main case includes an outside case made of a conductive material, and a bezel disposed on the cover member side of the outside case, supporting the cover member, and made of a conductive material;

the antenna disposed to a position not overlapping the outside case and bezel in plan view.

3. The electronic timepiece described in claim 1, further comprising:

a calendar wheel made from a non-conductive material disposed to a position on the cover member side of the antenna at a position not superimposed with the antenna in plan view.

4. The electronic timepiece described in claim 1, further comprising:

a solar panel disposed to a position on the cover member side of the drive module at a position not overlapping the antenna in plan view.

5. The electronic timepiece described in claim 1, wherein:

the antenna has a dielectric substrate and an antenna electrode formed on the dielectric substrate;

the dielectric substrate having a through-passage through which an operator used to operate the electronic timepiece passes.

6. The electronic timepiece described in claim 1, further comprising:

a wireless communication unit connected to the antenna;

the main case including an outside case, and the outside case and the back cover being made of a conductive material and connected to the ground of the wireless communication unit.

7. The electronic timepiece described in claim 1, further comprising:

a dial made from a non-conductive material and disposed to the cover member side of the drive module and antenna; and a ring member made from a non-conductive material and disposed to the cover member side of the dial.

* * * * *